US006790119B1

(12) United States Patent
Chia

(10) Patent No.: US 6,790,119 B1
(45) Date of Patent: Sep. 14, 2004

(54) SWIMMING TOY ANIMAL

(76) Inventor: Francis See Chong Chia, 17 Kadoorie Ave, Kowloon, Hong Kong (CN)

( * ) Notice: Subject to any disclaimer, the term of this patent is extended or adjusted under 35 U.S.C. 154(b) by 0 days.

(21) Appl. No.: 10/606,395

(22) Filed: Jun. 27, 2003

(51) Int. Cl.[7] ..... A63H 23/00
(52) U.S. Cl. ..... 446/158; 446/353; 446/356
(58) Field of Search ..... 446/153, 156, 446/158, 308, 309, 330, 332, 351, 352, 353, 356, 365, 376; 43/26.1, 26.2

(56) References Cited

U.S. PATENT DOCUMENTS 188,841 A * 3/1877 Baxter ..... 446/356
2,329,564 A * 9/1943 Thomas ..... 446/158
3,077,698 A * 2/1963 Glass ..... 446/158
3,835,581 A * 9/1974 Grieder ..... 446/158
4,832,650 A * 5/1989 Tong ..... 446/156

OTHER PUBLICATIONS

Copy of Web Page "http://www.igkids.net/raretupotoy.html" Showing Prior Art Toy.

* cited by examiner

*Primary Examiner*—Derris H. Banks
*Assistant Examiner*—Bena B. Miller
(74) *Attorney, Agent, or Firm*—Francis Marino

(57) ABSTRACT

A toy turtle is provided with a head, a tail, front right and left flippers, and rear right and left flippers extending from a body. A battery driven gear motor within the body causes linkage in the body to drive the front flippers back and forth, propelling the turtle through the water. The rear flippers are selectively positionable by the user to act in combination either as a rudder, controlling the direction in which the turtle swims when the flippers are positioned asymmetrically, or to control the turtle's swimming speed by increasing or reducing drag when the flippers are positioned symmetrically.

20 Claims, 4 Drawing Sheets

SWIMMING TOY ANIMAL

FIELD OF THE INVENTION

The present invention relates to a swimming toy. More specifically, this invention concerns a battery-powered toy in the form of a turtle for use in water such as in a swimming pool.

BACKGROUND AND OBJECTS OF THE INVENTION

Toys, which resemble animals and are capable of moving themselves along the land or in water, are well known. Such toys of the prior art tend to be either very limited in their function, or include complicated mechanisms and circuits for providing a variety of functions. For instance, the speed at which the toy propels itself is generally fixed or may require an expensive multi-speed motor. Such toys of the prior art tend to move in a straight line, which limits their usefulness in a defined area such as a swimming pool. Some toys are adapted to move in a circular pattern, but those which are adjustable to move in either a straight line or a circular pattern use either a complicated steering mechanism or a steering rudder to accomplish this function. Such mechanisms tend to be expensive and prone to fail, while such rudders are unnatural appendages when integrated into an animal shape such as a turtle. Thus, either the toy is more expensive to manufacture than the marketplace will tolerate, or the toy performance is impaired and, after a very short time, a child becomes bored with his or her toy and abandons it.

It is therefore an object of the present invention to provide an improved toy, which is inexpensive to manufacture, yet which is more useful and less complicated than those of the prior art.

It is a further object to provide a more natural appearance and movement, according to the animal being simulated.

It is a further object to provide a toy turtle, whose naturally shaped and proportioned flippers move as do a real turtle's, while being adjustable for simultaneously allowing the turtles swimming speed and direction to be controlled according to the environment in which it is used.

These objects are attained according to the present invention in a toy comprising a sea turtle shape whose front flippers are driven in a natural motion by a battery-operated motor to propel the turtle through the water, and whose rear flippers are manually positionable to steer the turtle and/or to regulate the turtle's swimming speed by increasing or reducing drag as the turtle swims through the water.

SUMMARY OF THE INVENTION

In accordance with the present invention, a toy turtle is provided which has upper and lower shell portions, which form a body. A head, a tail, front right and left flippers, and rear right and left flippers extend from the body. A battery driven gear motor within the body causes linkage in the body to drive the front flippers back and forth, propelling the turtle through the water, as do a real sea turtle's, for swimming. The rear flippers are positionable by the user to act either as a rudder, controlling the direction in which the turtle swims when the flippers are positioned asymmetrically, or to control the turtle's swimming speed by increasing or reducing drag when the flippers are positioned symmetrically.

According to another feature of the invention, a blow-molded float is contoured to extend into voids within the body and provide buoyancy so that the turtle floats as it swims.

It is anticipated by the inventor that the mechanism and system employed herein could alternatively be adapted for use in other animal shapes, such as say a crocodilian shape, a salamander, or such.

Besides flippers, other such appendages may be used within the spirit of the invention, such as fins, wings, or limbs, provided that the appendages serve to propel the animal through the water when driven by the motor.

The toy according to the present invention is expected to have a long-lasting appeal for a youngster, as it does more than simply paddle along in the water. Furthermore, such a toy can be produced at relatively low cost and should have a long service life, due to its simplicity and minimal number of components.

The features which are considered novel and most vital to the present invention are set forth in particular in the appended claims. The invention itself, however, both as to its construction and its method of operation, will be best understood from the following description of the preferred embodiment, when read in connection with the accompanying drawings.

DETAILED DESCRIPTION OF THE PREFERRED EMBODIMENT

Figure 1:
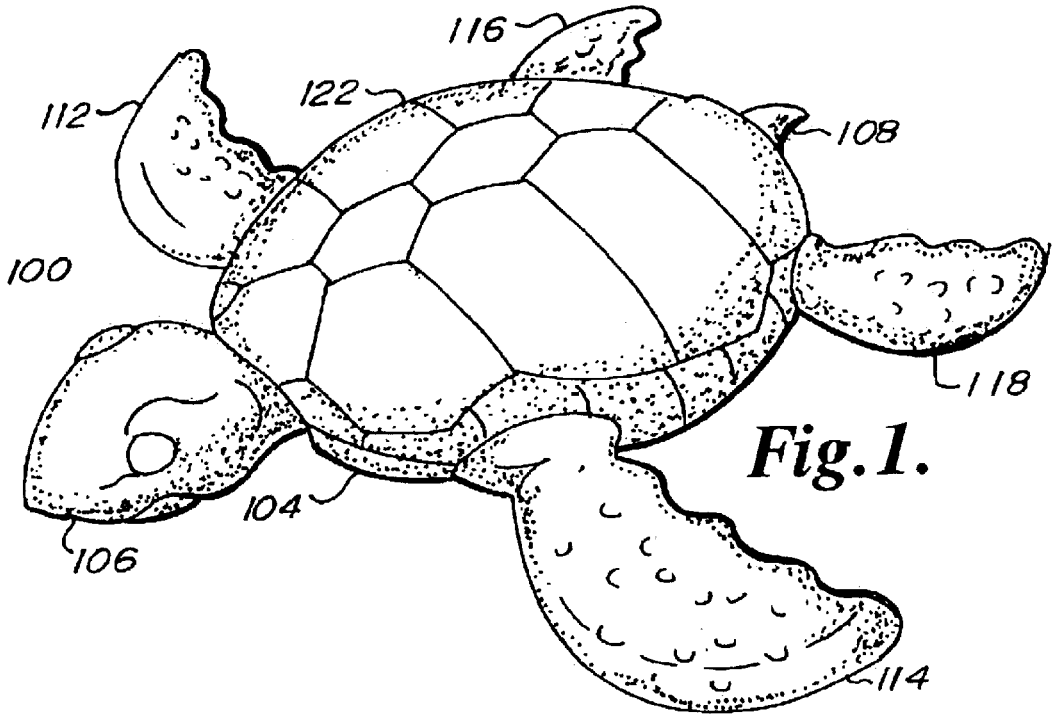
FIG. 1 is a top perspective view of a toy turtle according to the preferred embodiment of the invention.

FIGS. 1–8 show the preferred embodiment of the present invention wherein a toy in the form of sea turtle 100 is provided, having upper shell portion 102, lower shell portion 104, and appendages including head 106, tail 108, front right flipper 112, front left flipper 114, rear right flipper 116, and rear left flipper 118. It should be noted, especially since several of the drawings are bottom views, that the terms "left" and "right" refer to the turtle's left and right sides, not necessarily to the left and right sides of the drawings.

The upper and lower shell portions are held together by fasteners, glue, and or any other such method, to form hollow body 122 and to capture the appendages therebetween.

Also captured with the hollow body 122 are gear motor 124, battery housing 126, switch 128, and blow-molded float 130. A typical household battery (not shown) is positioned with the hollow interior of battery housing 126 through opening 132 in lower shell portion 104, and then sealingly encased by battery cover 134, which is removably secured to lower shell portion 104 by fasteners 136. Wiring 138 connects gear motor 124 to the battery through switch 128, such that the motor is energized when the switch is in its "on" position and is de-energized when the switch is in its "off" position. All electrical components, including the battery and its related connectors, switch 128, gear motor 124, and wiring 138, are sufficiently protected with appropriate sealants and gaskets to prevent wetting when turtle 100 is submerged in water.

All of the afore-listed flippers are loosely captured by the shell portions 102 and 104 in a fashion that allows some fore/aft pivoting relative to body 122. Front right flipper 112 includes vertical hole 142 that loosely surrounds vertical pin 144 of upper shell portion 102 to allow the flipper to pivot horizontally in forward and rearward directions about the axis of the pin. Front left flipper 114 includes vertical hole 146 that loosely surrounds vertical pin 148 of upper shell portion 102 to allow this flipper to pivot horizontally in forward and rearward directions about the axis of this pin. Rear right flipper 116 includes vertical hole 152 that loosely surrounds vertical pin 154 of upper shell portion 102 to allow this flipper to pivot horizontally in forward and rearward directions about the axis of this pin. And rear left flipper 118 includes vertical hole 156 which loosely surrounds vertical pin 158 of upper shell portion 102 to allow this flipper to pivot horizontally in forward and rearward directions about the axis of this pin.

When motor 124 is energized, eccentric 162 rotates such that vertical pin 164 revolves in a circular and clockwise motion.

Front left flipper 144 includes longitudinal extension 166, having vertical pin 168 extending downwardly there-from.

Front right flipper 122 includes longitudinal extension 172, having there-through slot 174 for loosely receiving pin 164 and also having there-through slot 176 for loosely receiving pin 168.

Figure 5:
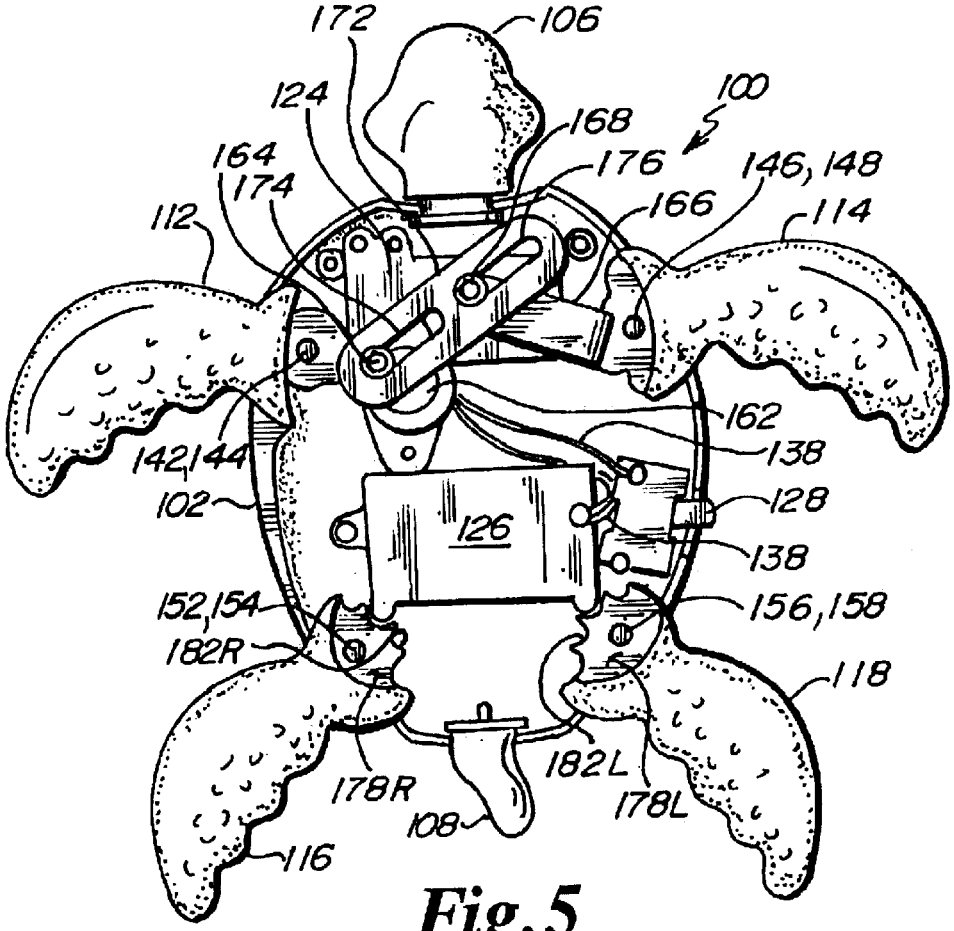
FIG. 5 is a bottom view of the toy turtle of FIG. 1, with the bottom shell portion and float removed and the front flippers in their most rearward position.
Figure 2:
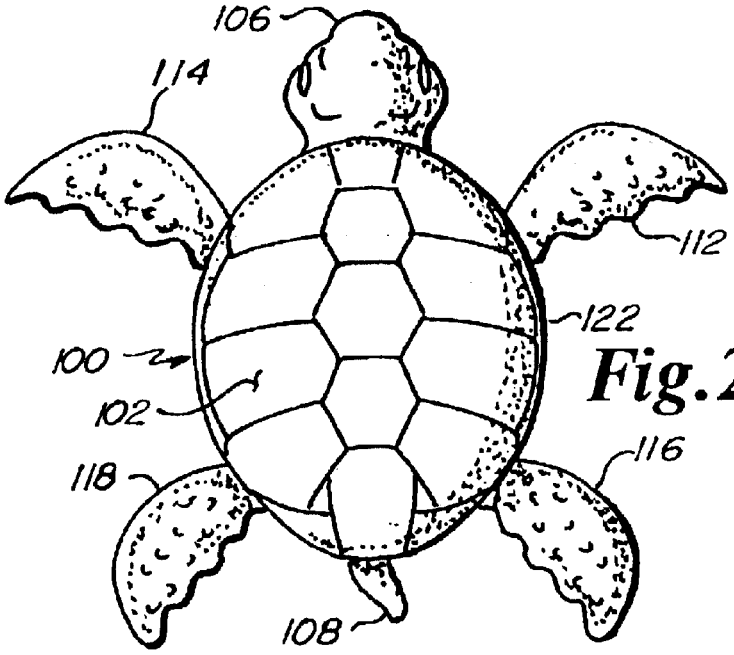
FIG. 2 is a top view of the toy turtle of FIG. 1.
Figure 8:
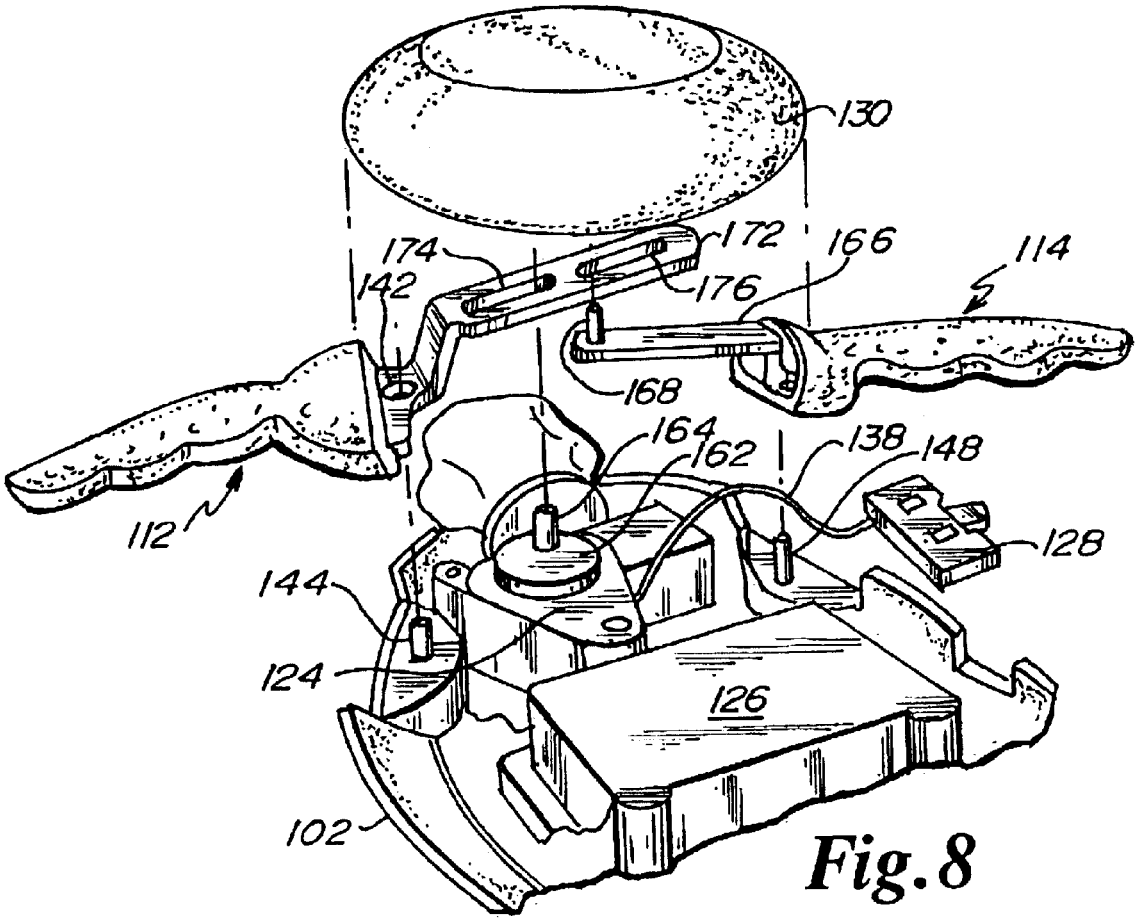
FIG. 8 is a partial exploded view of the front end of the toy turtle of FIG. 1, showing the swimming mechanism and front flippers in the top shell portion.
Figure 4:
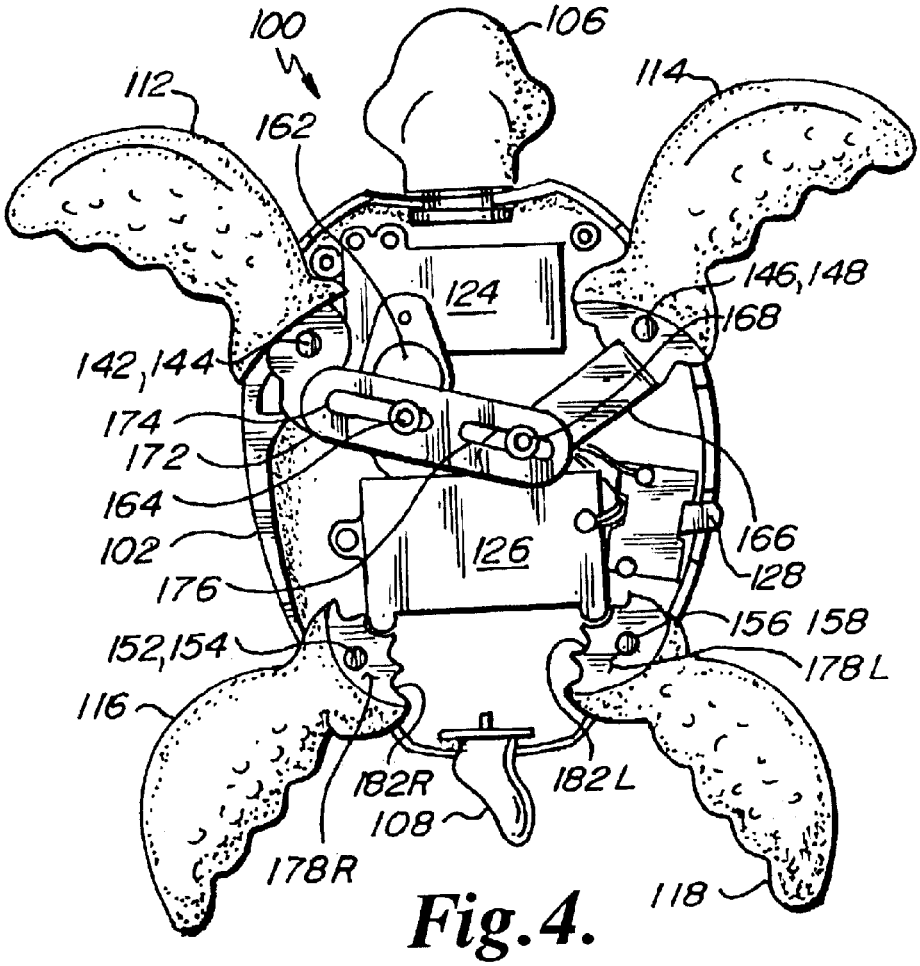
FIG. 4 is a bottom view of the toy turtle of FIG. 1, with the bottom shell portion and float removed and the front flippers in their most forward position.
Figure 3:
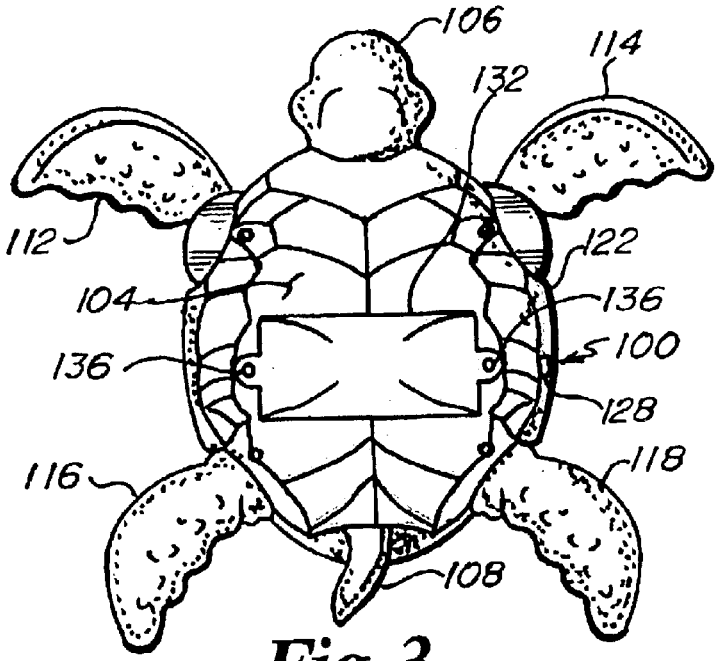
FIG. 3 is a bottom view of the toy turtle of FIG. 1.

As should be best appreciated from FIGS. 4, 5, and 8, the revolution of pin 164 within slot 174 forces extension 172 to move in a cyclic fore/aft motion, thereby causing front right flipper 112 to pivot cyclically in a fore/aft motion about pin 144. This cyclic fore/aft motion of extension 172, and therefore of its slot 174, additionally forces pin 168, and therefore longitudinal extension 166 of front left flipper 114, to move in a similar cyclic fore/aft motion, thereby causing front left flipper 114 to pivot cyclically in a fore/aft motion about pin 148, in phase with the motion of front right flipper 112. The front flippers are both hydro-dynamically shaped to provide less drag when moving forward in the water than when moving backward in the water. This fore/aft motion of the flippers, combined with such a forward drag advantage, efficiently propels the turtle forward in the water.

Hollow blow-molded float 130 is filled with air to offset the weight density of the other components and thereby provide buoyancy to allow the turtle to swim at the water surface. Alternatively, some or all of the components of the toy could be made of material that is less dense than water, or air could be trapped be the assembling together of the upper and lower shell portions, to provide the same buoyancy.

Each of rear flippers 116 and 118 includes extension 178R and 178L, including ratcheting indentations 182R and 182L for being selectively engaged by vertical pins 184R or 182L that extend from upper shell portion 102. This allows the flippers to be pivoted into a plurality of distinct for/aft positions. As rear right flipper 116 is forcibly pivoted about pin 154 by the user, pin 184R firmly engages one of ratcheting indentations 182R to hold the flipper in the selected position. As rear left flipper 118 is forcibly pivoted about pin 158 by the user, pin 184L firmly engages one of ratcheting indentations 182L to hold this flipper in the selected position.

Pivoting of both rear flippers 116 and 118 fully backward minimizes drag as the turtle swims through the water, and thereby allows the turtle to swim fastest. As the flippers are incrementally and symmetrically forced into more forward positions, the swimming is slowed by increasing drag as the turtle moves through the water.

Figure 6:
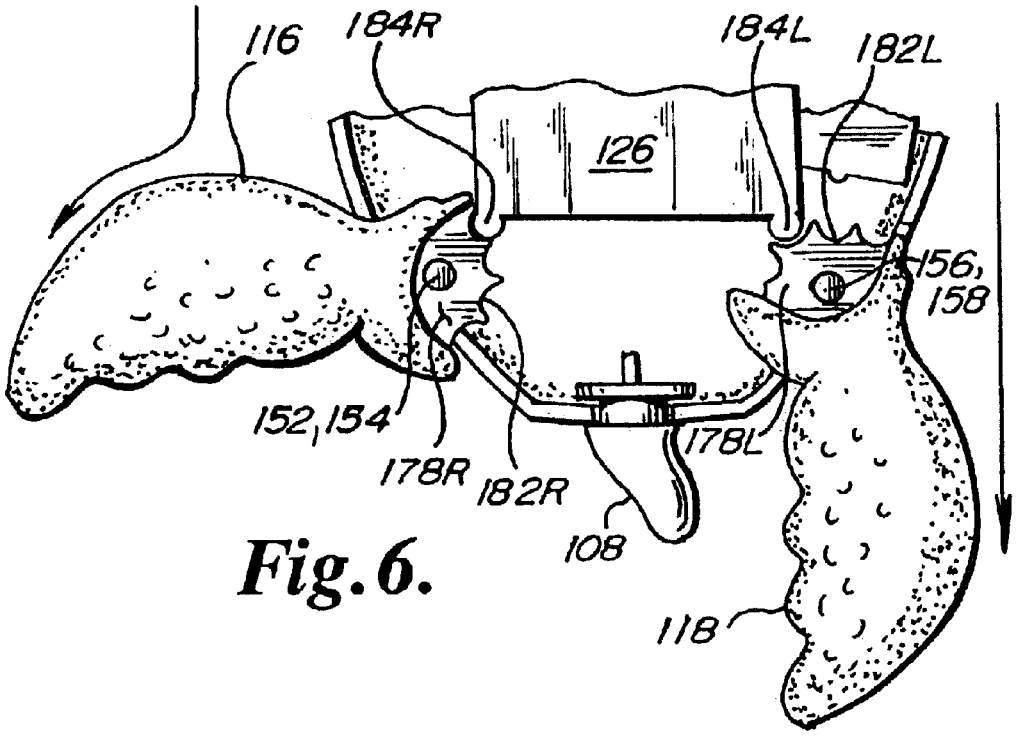
FIG. 6 is a partial bottom view of the rear end of the toy turtle of FIG. 1, with the rear flippers asymmetrically positioned for rightward turning while swimming.

Swimming direction can also be controlled by the asymmetrical positioning of the rear flippers. This is best appreciated by viewing FIGS. 6 and 7. For the sharpest rightward turning, rear right flipper 116 is pivoted into its most forward position for maximum drag on the turtle's right side, while rear left flipper 118 is pivoted into its most rearward position for minimum drag on the turtle's left side, as shown in FIG. 6. This will cause the turtle's swimming pattern to be clockwise in the tightest circle. Clockwise patterns in incrementally larger circles at incrementally faster speeds can be accomplished by pivoting only the rear right flipper 116 incrementally rearward, or clockwise patterns in incrementally larger circles at incrementally slower speeds can be accomplished by pivoting only the rear left flipper 118 incrementally forward.

Figure 7:
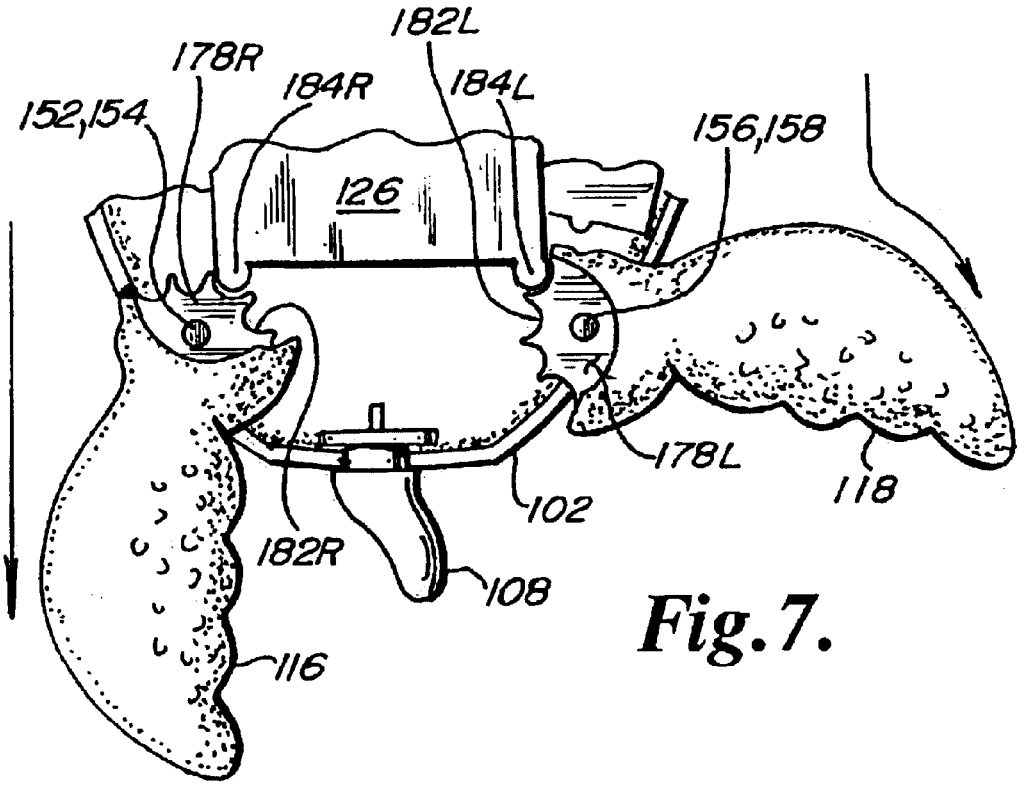
FIG. 7 is a partial bottom view of the rear end of the toy turtle of FIG. 1, with the rear flippers asymmetrically positioned for leftward turning while swimming.

Alternatively, For the sharpest leftward turning, rear left flipper 118 is pivoted into its most forward position for maximum drag on the turtle's left side, while rear right flipper 116 is pivoted into its most rearward position for minimum drag on the turtle's right side, as shown in FIG. 7. This will cause the turtle's swimming pattern to be counter-clockwise in the tightest circle. Counter-clockwise patterns in incrementally larger circles at incrementally faster speeds can be accomplished by pivoting only the rear left flipper 118 incrementally rearward, or counter-clockwise patterns in incrementally larger circles at incrementally slower speeds can be accomplished by pivoting only the rear right flipper 116 incrementally forward.

As can be appreciated, twenty-five distinct swimming speeds and swimming patterns can hereby be realized through the repositioning of only two components and without the need for an expensive multi-speed motor and multi-position switch.

The foregoing description and drawings provide only the preferred of many possible embodiments of the inventions, and are not intended to limit the invention. Many obvious alterations could be made without departing in any way from the spirit of the present invention. It is therefore intended that only the following claims should limit the invention.

I claim:

1. A swimming animal-shaped toy comprising:

a motor, one or more frontal appendages in the form of one of flippers, fins, or limbs, said one or more frontal appendages driven by said motor to propel the toy through water;

one or more rear appendages in the form of one of flippers, fins, or limbs, said one or more rear appendages being adjustable independent of said frontal appendages to control both of the toy's propulsion speed and direction in the water.

2. The toy of claim 1 wherein said one or more rear appendages are each independently adjustable to control both of the toy's propulsion speed and direction.

3. The toy of claim 1 wherein said one or more frontal appendages is two or more frontal appendages.

4. The toy of claim 3 wherein said one or more rear appendages is two or more rear appendages.

5. The toy of claim 1 wherein said one or more rear appendages is two or more rear appendages.

6. The toy of claim 5 wherein said two or more rear appendages are each independently adjustable to control both of the toy's propulsion speed and direction.

7. The toy of claim 6 wherein the toy is turtle-shaped and said two or more frontal appendages are a pair of left and right front flippers and said two or more rear appendages are a pair of left and right rear flippers.

8. The toy of claim 2 wherein said left and right front flippers are each hydro-dynamically contoured for lower resistance to forward movement through the water and higher resistance to rearward movement through the water and wherein said left and right front flippers are driven cyclically in a forward and rearward motion by said motor, thereby causing said toy to move forwardly in the water.

9. The toy of claim 8 wherein said cyclically driven forward and backward motion is along a first horizontal plane.

10. The toy of claim 9 wherein each of said left and right rear flippers are adapted to be independently adjusted by moving along a second horizontal plane from a least resistive position that causes least resistance to the forward movement of the toy through the water into a position that selectively causes more resistance to forward movement through the water on the same left or right side of the toy, to thereby cause the toy's propulsion to be curved toward said same side.

11. The toy of claim 10 wherein both of said left and right rear flippers are adapted to be symmetrically adjusted by moving along said second horizontal plane from said least resistive position into a position that selectively causes more resistance to forward movement through the water equally on both said left and right sides of the toy, to thereby cause the toy's propulsion speed to be slowed.

12. The toy of claim 11 wherein said first horizontal plane and said second horizontal plane are substantially coplanar.

13. The toy of claim 12 wherein said toy is adapted to float at or near the water's surface.

14. The toy of claim 9 wherein both of said left and right rear flippers are adapted to be symmetrically adjusted by moving along a second horizontal plane from a least resistive position that causes least resistance to the forward movement of the toy through the water into a position that selectively causes more resistance to forward movement through the water equally on both the left and right sides of the toy, to thereby cause the toy's propulsion speed to be slowed.

15. The toy of claim 14 wherein said first horizontal plane and said second horizontal plane are substantially coplanar.

16. The toy of claim 14 wherein said toy is adapted to float at or near the water's surface.

17. A turtle-shaped toy for use in water and adapted to float at or just below the water's surface, comprising a body having a front left and right flippers protruding there-from, wherein said front left and right flippers are cyclically driven in a forward to rearward motion on a first plane that is substantially coplanar with the water's surface, by a motor disposed within said body, and wherein said front left and right flippers are both hydro-dynamically contoured to have less drag when moving forwardly in the water than when moving rearward so that said cyclically driven motion propels the toy forwardly in the water further comprising rear left and right flippers protruding there-from, wherein said rear left and right flippers are adapted to be adjusted by moving along a second plane that is substantially coplanar with the water's surface, from a least resistive position having less drag when moving forwardly in the water into a plurality of positions that cause varying degrees of increased drag, to thereby cause the toy's propulsion speed to be reduced.

18. The toy of claim 17 wherein said rear left and right flippers are adapted to be adjusted by moving along said second plane independently of and asymmetrically of each other, so that drag may be selectively balanced between the toy's left and right sides, to thereby cause the toy's propulsion to curve toward said either side, and to simultaneously control the degree of curvature and the rate of said propulsion speed.

19. A turtle-shaped toy for use in water and adapted to float at or just below the water's surface, comprising a body having a front left and right flippers protruding there-from, wherein said front left and right flippers are cyclically driven in a forward to rearward motion on a first plane that is substantially coplanar with the water's surface, by a motor disposed within said body, and wherein said front left and right flippers are both hydro-dynamically contoured to have less drag when moving forwardly in the water than when moving rearward so that said cyclically driven motion propels the toy forwardly in the water further comprising rear left and right flippers protruding there-from, wherein said rear left and right flippers are adapted to be adjusted by moving along a second plane independently of and asymmetrically of each other, so that drag may be selectively increased on either of the toy's left or right sides, relative to the other side, to thereby cause the toy's propulsion to curve toward said either side.

20. A method of controlling the speed and curvature of a self-propelled water toy as it is propelled through the water, said method comprising:

providing a pair of flaps, one of which is disposed on a rear left portion and one of which is disposed on a rear right portion of the toy, said flaps each being positionable between at least a highest drag state and a lowest drag state, adjusting one of said flaps towards said flap's highest or lowest drag state, to increase or decrease said flap's hydro-dynamic drag relative to the other flap, thereby causing or changing curvature of the toy's propulsion, adjusting both of said flaps symmetrically towards their highest or lowest drag states, to increase or decrease the overall drag of the toy symmetrically, thereby changing the speed of the toy's propulsion, and asymmetrically adjusting both of said flaps, towards each flaps highest or lowest drag state independently, thereby causing and controlling both the speed and curvature of the toy's propulsion simultaneously.

* * * * *